US005713701A

United States Patent [19]

Marshall

[11] Patent Number: 5,713,701

[45] Date of Patent: Feb. 3, 1998

[54] FOUNDATION PILING

[76] Inventor: Frederick S. Marshall, 916 Ridgewood Ter., Arlington, Tex. 76012

[21] Appl. No.: 568,179

[22] Filed: Dec. 6, 1995

[51] Int. Cl.[6] ..... F02D 5/60

[52] U.S. Cl. ..... 405/232; 405/257; 405/255; 405/252

[58] Field of Search ..... 405/229, 230, 405/231, 232, 233, 249, 250, 251, 255, 256, 257, 216

[56] References Cited

U.S. PATENT DOCUMENTS

| | | | |
|---|---|---|---|
| 13,532 | 2/1855 | Breuchaud . | |
| 996,397 | 6/1911 | Breuchaud . | |
| 1,181,212 | 2/1916 | Clark . | |
| 2,200,469 | 5/1940 | Cox | 405/216 X |
| 3,375,884 | 4/1968 | Bodine, Jr. | 175/22 |
| 3,487,646 | 1/1970 | Gatien | 405/257 |
| 3,899,891 | 8/1975 | Kelly et al. | 61/56 |
| 3,964,056 | 6/1976 | Shibuya et al. | 405/256 X |
| 4,190,383 | 2/1980 | Pryke et al. | 405/252 |
| 4,659,255 | 4/1987 | Shiraishi et la. | 405/216 |
| 4,735,527 | 4/1988 | Bullivant | 405/232 |
| 4,836,717 | 6/1989 | Landaeus et al. | 405/252 |
| 5,096,333 | 3/1992 | Bassett | 405/244 |
| 5,131,790 | 7/1992 | Simpson | 405/236 |
| 5,228,807 | 7/1993 | Willcox, Jr. et al. | 405/232 |
| 5,259,702 | 11/1993 | Simpson | 405/233 |
| 5,320,453 | 6/1994 | Bullivant | 405/239 |
| 5,399,055 | 3/1995 | Dutton, Jr. | 405/230 |
| 5,505,030 | 4/1996 | Michalcewiz et al. | 405/231 X |

FOREIGN PATENT DOCUMENTS

| | | | |
|---|---|---|---|
| 2256989 | 8/1975 | France | 405/256 |
| 1213548 | 11/1970 | United Kingdom | 405/256 |

*Primary Examiner*—Tamara L. Graysay
*Assistant Examiner*—Frederick L. Lagman
*Attorney, Agent, or Firm*—Robert A. Felsman; Mark D. Perdue

[57] ABSTRACT

A metallic piling sleeve member filled with solidified or cured cementitious material and a hollow, cylindrical outer sleeve member having a diameter larger than that of the metallic piling sleeve member are provided. The outer sleeve member is placed generally concentrically around the piling sleeve member and the piling and outer sleeve members are vertically driven into the soil. Further metallic piling sleeve and outer sleeve members are successively vertically driven into the soil until the piling is complete and the metallic piling sleeve and outer sleeve members abut one another in vertical relation.

20 Claims, 1 Drawing Sheet

FOUNDATION PILING

BACKGROUND OF THE INVENTION

1. Field of the Invention

The present invention relates broadly to pilings for the foundations of structures. More particularly, the present invention relates to methods of forming reinforced piling structures.

2. Background Information

It is a common practice in the construction arts to form foundation pilings by vertically driving piling sections into the soil. The sections may be concrete cylinders or hollow steel sleeves that are driven into the earth until friction between the earth and the sidewall of the piling is sufficient to support the weight of a structure. Examples of such pilings are found in U.S. Pat. No. 996,397, Jun. 27, 1911 and Re. U.S. Pat. No. 13,532, Feb. 18, 1913, to Breuchaud. These patents disclose pilings formed of concentric sleeves of steel that are driven into the soil. After the hollow sleeves are driven into the soil, the sections are cleared of soil and the completed structure filled with concrete or grout and capped.

U.S. Pat. No. 5,228,807, Jul. 20, 1993 to Willcox, Jr. discloses a method of forming a foundation piling in which concrete cylinders are driven vertically into the soil. Hollow sleeve sections are driven concentrically around the exterior of the concrete cylinders. The resulting piling structure is capped with a cap having a recess, wherein load is distributed only onto the concrete cylinders.

Pilings in which only hollow sleeves are driven into the soil suffer from the disadvantage that the sleeves must be cleared of soil before the concrete can be poured into the piling to increase its compressive strength. Pilings formed by driving concrete cylinders into the soil suffer from the disadvantage that the concrete cylinders lack tensile strength and are subject to disintegration or failure if rocks or other hard materials are encountered while driving the cylinders into the soil.

A needs exists, therefore, for a foundation piling having the advantages of both sleeve-type and concrete-cylinder-type pilings, but without the disadvantages associated with these pilings.

SUMMARY OF THE INVENTION

It is a general object of the present invention to provide an improved reinforced foundation piling. This and other objects of the present invention are achieved by providing a metallic piling sleeve member filled with solidified or cured cementitious material and a hollow, cylindrical outer sleeve member having a diameter larger than that of the metallic piling sleeve member. The outer sleeve member is placed generally concentrically around the piling sleeve member and the piling and outer sleeve members are vertically driven into the soil. Further metallic piling sleeve and outer sleeve members are successively vertically driven into the soil until the piling is complete and the metallic piling sleeve and outer sleeve members abut one another in vertical relation.

According to the preferred embodiment of the present invention, drive members are employed in the driving steps. The drive members have lengths less than those of the metallic piling and outer sleeve members, wherein, upon completion of the piling the joints between abutting metallic piling sleeve members and the joints between abutting outer sleeve members do not overlap.

According to the preferred embodiment of the present invention, the metallic piling sleeve and outer sleeve members are driven into the soil simultaneously, such that there is no relative movement therebetween.

According to the preferred embodiment of the present invention, the cementitious material is concrete.

According to the preferred embodiment of the present invention, the outer sleeve member is formed of the same material as the metallic sleeve member, and the metallic sleeve member is coated with an anti-corrosive material.

According to the preferred embodiment of the present invention, the piling is capped with a piling cap that distributes load over the outer sleeve member, the metallic filing sleeve member, and the solidified cementitious material.

DESCRIPTION OF THE PREFERRED EMBODIMENT

Figure 1:
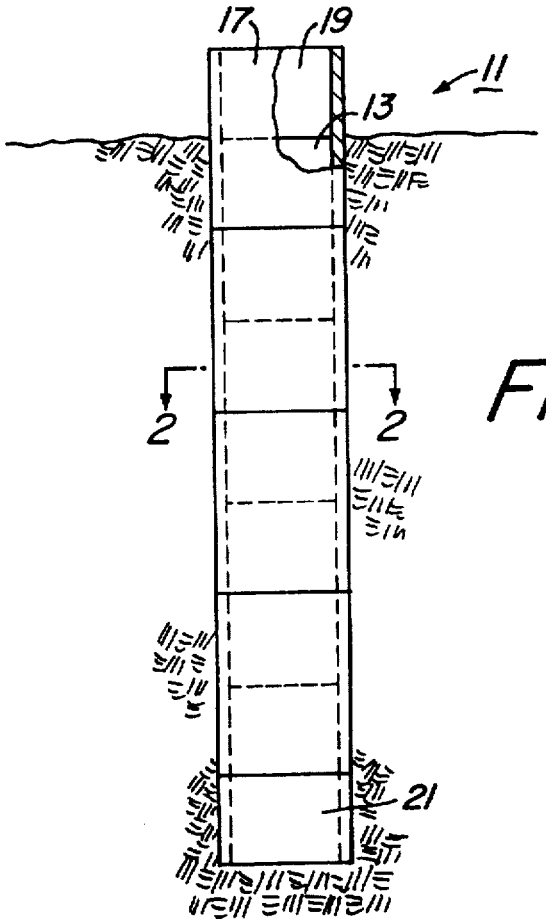
FIG. 1 is an elevation view, partially in section, of the foundation piling according to the present invention.
Figure 2:
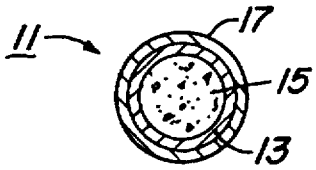
FIG. 2 is a cross-section view, taken along line 2—2 of FIG. 1, of the foundation piling of FIG. 1.

Referring now to the figures, and specifically to FIG. 1, an elevation view, partially in section, of a foundation piling 11 according to the present invention is illustrated. FIG. 2 is a cross-section view, taken along section 2—2 of FIG. 1, of foundation piling 11 according to the present invention.

Foundation piling 11 comprises a series of metallic piling sleeve members 13, stacked in abutting vertical relation. Each metallic piling member 13 comprises a steel pipe having an outer diameter of between about 2¼ and 2¾ inches and an inner diameter of between about 2 and 2½ inches. Other dimensions may be appropriate depending on the particular application. Metallic piling members 13 are filled with a solidified or cured cementitious material 15, preferably concrete, which increases the compressive strength of piling 11. Having cementitious material 15 surrounded by metallic piling member 13 improves the tensile strength of piling member 13 and increases its resistance to breakage and crumbling in the event that rocks or other hard earthen materials are encountered when piling members 13 are driven into the soil. The metallic sleeve is treated with an anti-corrosive material, preferably galvanization, to retard corrosion and increase the useful life of piling 11.

A series of hollow, cylindrical outer sleeve members 17 concentrically surround piling members 13. Outer sleeve members 17 are formed of steel pipe having an outer diameter of between about 2½ and 3 inches and an inner diameter of between about 2¼ and 2¾ inches. Outer sleeve members 17 protect piling members 13 against lateral loading and corrosion. Preferably, piling members 13 and outer sleeve members 17 are dimensioned to produce a sliding or running fit when concentrically arranged, although a slight interference fit is acceptable. According to the preferred embodiment of the present invention, both piling members 13 and outer sleeve members 17 are 12 inches in length and the joints between abutting sections of piling members 13 and outer sleeve members 17 do not overlap. Twelve inches is a preferred length to permit these components to be handled easily in the crawl spaces of existing structures needing foundation reinforcement. To maintain this overlap, and to insure that the column of piling sleeve members 13 and outer sleeve members 17 are the same height, piling and outer sleeve drive members 19, 21 are provided. Piling drive member 19 is of the same construction as piling sleeve member 13, but is six inches in length. Similarly, outer sleeve drive member 21 is of similar construction to outer sleeve member 17, but is six inches in length.

Figure 4:
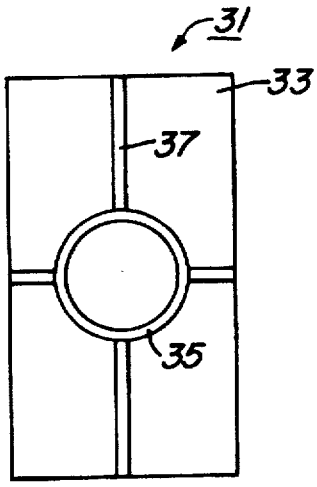
FIG. 4 is a bottom plan view of the piling cap of FIG. 3.
Figure 3:
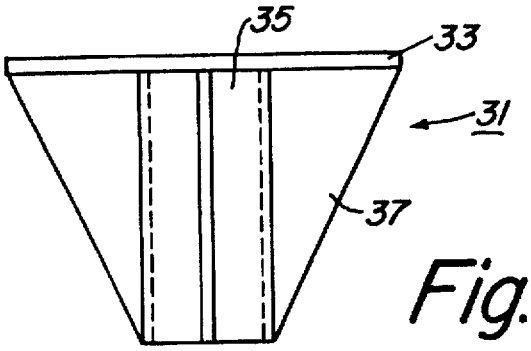
FIG. 3 is an elevation view of the piling cap according to the present invention.

FIGS. 3 and 4 are elevation and bottom plan views, respectively of a piling cap 31 according to the present invention. Piling cap 31 includes a steel plate 33 that is between approximately ¾ and 1 inch thick and measures 16×10 inches. A cylindrical portion 35 is welded to plate 33 and has an inner diameter slightly larger than the outer diameter of outer sleeve 17. Cylindrical member 35 is longer than outer sleeve member 17, preferably 16 inches, such that when fit over piling the top of piling 11, at least one joint between abutting outer sleeve members 17 will be covered by piling cap 31. Four triangular braces 37 are welded to plate 33 and cylindrical member 35 to provide stability. When assembled on the top of piling 11, piling cap 31 distributes load onto piling member 13, cementitious material 15, and outer sleeve member 17.

Referring now to FIGS. 1–4, the method of forming piling 11 according to the present invention is described. First, a pair of outer sleeve drive members 21 are stacked concentrically about a piling sleeve member 13. This assembly is driven into the soil until the lower outer sleeve drive member 21 and one-half of piling sleeve member 13 are submerged. The upper outer sleeve drive member 21 then is removed and replaced with a full-size outer sleeve member 17. A piling drive member 19 then is stacked on top of piling member 13 and concentrically with outer sleeve member 17. This assembly then is driven further into the soil. This process is repeated until frictional engagement between piling 11 and the soil becomes great enough to support a load. Piling 11 then is capped with a piling cap 31, as described above.

Preferably, piling and outer sleeve members 13, 17 are driven into the soil simultaneously, with no relative movement between the two. Use of piling and outer sleeve drive members 19, 21 permits the joints of piling and outer sleeve members 13, 17 not to overlap, and provides a solid structure to be driven into the soil.

The foundation piling according to the present invention provides a number of advantages. A principal advantage is that the piling provides the advantages of both sleeve-type and concrete-cylinder-type pilings, with the disadvantage of neither.

The invention has been described with reference to a preferred embodiment thereof. It is thus not limited, but is susceptible to variation and modification without departing from the scope and spirit of the invention.

I claim:

1. A method of forming a foundation piling, the method comprising the steps of:

providing a metallic sleeve member filled with solidified cementitious material;

providing an outer metallic sleeve member having a diameter larger than that of the metallic sleeve member;

placing the outer metallic sleeve member generally concentrically around the metallic sleeve member;

simultaneously vertically driving the metallic and outer metallic sleeve members into the soil; and repeating the foregoing steps until the piling is complete, with metallic sleeve members abutting one another in vertical relation and outer metallic sleeve members abutting one another in vertical relation.

2. The method according to claim 1 further comprising the step of employing drive members in the driving step, the drive members having lengths less than those of the metallic and outer metallic sleeve members, wherein, upon completion of the piling, the joints between abutting metallic sleeve members and the joints between abutting outer metallic sleeve members do not overlap.

3. The method according to claim 1 wherein the cementitious material is concrete.

4. The method according to claim 1 wherein the outer metallic sleeve member is formed of the same material as the metallic sleeve member.

5. The method according to claim 1 wherein the metallic sleeve member is coated with anti-corrosive material.

6. The method according to claim 1 further comprising the step of capping the piling with a piling cap that distributes load over the outer metallic sleeve member, the metallic sleeve member, and the solidified cementitious material.

7. A method of forming a foundation piling in soil, the method comprising the steps of:

a) vertically driving a cylindrical, metallic piling sleeve filled with cured cementitious material at least partially into the soil;

b) vertically driving a hollow, cylindrical, metallic outer sleeve into the soil around and generally concentric with the piling sleeve member;

c) abutting the outer sleeve with a second, similar outer sleeve;

d) abutting the piling sleeve with a second, similar piling sleeve;

e) vertically driving the piling and outer sleeves into the soil; and repeating steps a through e until the piling is complete.

8. The method according to claim 7 wherein the cementitious material is concrete.

9. The method according to claim 7 wherein the outer sleeve is formed of the same material as the piling sleeve.

10. The method according to claim 7 wherein the piling sleeve member is coated with anti-corrosive material.

11. The method according to claim 7 further comprising the step of placing a drive member against the piling sleeve prior to vertically driving the outer sleeve, the drive member having a length less than that of the outer sleeve, wherein, upon completion of the piling, the joints between abutting piling sleeves and the joints between abutting outer sleeves do not overlap.

12. The method according to claim 7 further comprising the step of placing a drive member against the outer sleeve prior to vertically driving the piling sleeve, the drive member having a length less than that of the piling sleeve, wherein, upon completion of the piling, the joints between abutting piling sleeves and the joints between abutting outer sleeves do not overlap.

13. The method according to claim 7 further comprising the step of capping the completed piling with a piling cap that distributes load over the outer sleeve, the piling sleeve, and the cured cementitious material.

14. The method according to claim 7 wherein the piling and outer sleeves are driven simultaneously, with no relative movement therebetween.

15. The method according to claim 7 wherein the first hollow cylindrical outer sleeve member driven into the soil is one-half the length of the first cylindrical piling sleeve member.

16. A method of forming a foundation piling in soil, the method comprising the steps of:

a) vertically driving a cylindrical, metallic piling sleeve filled with cured cementitious material at least partially into the soil;

b) vertically driving a hollow, cylindrical, metallic outer sleeve into the soil around and generally concentric with the piling sleeve member;

c) abutting the outer sleeve with a second, similar outer sleeve;

d) abutting the piling sleeve with a piling drive member;

e) vertically driving the outer sleeve, piling sleeve, and drive member into the soil until the piling sleeve is fully submerged and the outer sleeve is partially submerged;

f) removing the piling drive member;

g) abutting the piling sleeve with a second, similar piling sleeve;

h) abutting the outer sleeve with an outer drive member;

i) vertically driving the piling sleeves further into the soil until the second sleeve is partially submerged;

j) removing the outer drive member;

repeating steps b through h until the piling is complete; and capping the completed piling with a piling cap that distributes load over the outer sleeve, the piling sleeve, and the cured cementitious material.

17. The method according to claim 16 wherein the cementitious material is concrete.

18. The method according to claim 16 wherein the outer sleeve is formed of the same material as the piling sleeve.

19. The method according to claim 16 wherein the piling sleeve member is coated with anti-corrosive material.

20. The method according to claim 16 wherein the piling and outer sleeves are driven simultaneously, with no relative movement therebetween.

* * * * *